US005199991A

United States Patent [19]

Chance

[11] Patent Number: 5,199,991

[45] Date of Patent: Apr. 6, 1993

[54] SHORT DWELL COATER APPARATUS

[75] Inventor: James L. Chance, Rockton, Ill.

[73] Assignee: Beloit Technologies, Inc., Wilmington, Del.

[21] Appl. No.: 688,002

[22] Filed: Apr. 19, 1991

[51] Int. Cl.[5] ..... B05C 3/18; B05C 11/04

[52] U.S. Cl. ..... 118/410; 118/413; 118/419

[58] Field of Search ..... 118/410, 413, 419; 427/356, 357, 358

[56] References Cited

U.S. PATENT DOCUMENTS

| | | | |
|---|---|---|---|
| 2,521,666 | 9/1950 | Knight et al. | 118/50 |
| 3,413,143 | 11/1968 | Cameron et al. | 118/410 |
| 3,640,752 | 2/1972 | Ishiwata et al. | 427/294 |
| 3,735,729 | 5/1973 | Bird | 118/50 |
| 4,257,343 | 3/1981 | Kullander | 118/50 |
| 4,628,856 | 12/1986 | Burgdorf | 118/50 |
| 4,834,018 | 5/1989 | Sollinger et al. | 118/410 |
| 4,903,632 | 2/1990 | Sollinger | 118/419 X |

FOREIGN PATENT DOCUMENTS 8804959 7/1988 PCT Int'l Appl. .

OTHER PUBLICATIONS

"The Flow Characteristics In A Short Dwell Coater" by D. E. Eklund & P. C. Norrdahl; *Coating Conference* 1986; pp. 99–102.

"Relationship Between Flow Instability In Short Dwell . . . " by N. G. Triantafillopoulos & C. K. Aidun; *Coating Conference* 1990; pp. 309–324.

*Primary Examiner*—Michael G. Wityshyn

*Attorney, Agent, or Firm*—Dirk J. Veneman; Raymond W. Campbell; David J. Archer

[57] ABSTRACT

A short dwell coater apparatus is disclosed for applying coating material onto a web guided by a backing roll. The apparatus includes a coater housing which is disposed in close proximity to the backing roll. The arrangement is such that the web guided by the backing roll moves between the backing roll and the housing. The housing defines an application chamber which is open towards the web and which extends along the web in a cross-machine direction. The application chamber is connected to a source of coating material such that the coating material is applied to the web during movement of the web past the chamber. The coater housing has an upstream lip which is disposed upstream relative to the chamber and adjacent to the web. The lip defines an upstream coating overflow for permitting excess coating material to flow therethrough. A flexible coater metering blade is disposed downstream relative to the chamber. The blade extends from the housing towards the web for metering the coating material applied to the web. A perforate conduit is disposed within the chamber and extends in a cross-machine direction. The conduit permits the flow therethrough of a vortex of entrained air generated within the chamber such that in use of the apparatus, when the vortex of entrained air is generated within the chamber, the air flows through the perforate conduit away from the chamber so that streaking of the coating material due to the intermittent escape of the entrained air past the metering blade is inhibited.

7 Claims, 1 Drawing Sheet

SHORT DWELL COATER APPARATUS

BACKGROUND OF THE INVENTION

1. Field of the Invention

The present invention relates to a short dwell coater apparatus for applying coating material onto a web guided by a backing roll.

More particularly, the present invention relates to a short dwell coater apparatus having an upstream overflow and a downstream metering blade.

2. Information Disclosure Statement

In the papermaking art, a web of paper may be coated with various coating materials in order to decrease the porosity of the web or to enhance the printability thereof.

Various coaters have been proposed which generally fall into the following categories. First, on-line coaters include size presses for applying a thin coating of size onto the dried web prior to calendering thereof. Other on-line coaters include coaters for producing so-called "lightweight coated" or LWC paper.

Second, off-line coaters are coaters for applying coating material onto a web supplied from an unwind reel.

One method of coating a web applicable to both of the aforementioned categories includes the application of coating material to the web through a train of counter-rotating rolls. The roll farthest from the web is partially submerged in a pan filled with coating material. Such prior art coaters while generally satisfactory at low speed coating operations, tend to be difficult to control when operating at high speed because the thickness of the coating applied to the web is difficult to control.

Another prior art type fountain coater includes supplying coating material directly to the web supported by a backing roll by means of a cross-machine directional coater trough, or the like. Excess coating material is then subsequently removed from the web by means of a flexible downstream doctor blade.

The aforementioned method of coating a web suffers from the drawback that the coating material tends to soak into the surface of the web dependent on the porosity of the web to be coated, thereby using considerable quantities of the coating material.

More recently, the problems of controllability of the thickness of the coating material and the amount of coating material required for a given length of web were overcome by the introduction of the so-called "Short Dwell Coater", or SDC.

Essentially, the short dwell coater includes an application chamber defined by a housing, the chamber being supplied with pressurized coating material.

The application chamber in the short dwell coater is open to the web which is disposed between the chamber and a backing roll for guiding the web. A metering blade is disposed at the downstream end of the application chamber, and an overflow weir is disposed at the upstream end of the chamber for permitting the overflow of excess coating material metered by the downstream metering blade.

Much success has been experienced with the use of the short dwell coater mainly because the distance between the upstream overflow and the downstream metering blade is relatively short so that the time of application of the coating material to the web is relatively short. Such short dwell of the web during passage past the application zone causes minimal absorption of the coating material into the web, thereby economizing on the amount of coating material required.

Additionally, by regulating the pressure at which the coating material is supplied to the application chamber and by controlling the pressure applied to the metering blade, the thickness or weight of the coating applied to the web may be accurately determined.

However, a problem has been experienced in the use of short dwell coaters when operated at high speeds above 4,500 feet per minute. More specifically, as the machine speed increases above 4,500 feet per minute, there exists a tendency for the web to draw air through the upstream overflow into the application chamber. Such entrained air flows in a direction generally opposite to the direction of flow of the coating material and tends to generate an air vortex within the application chamber.

The air vortex usually rotates in a clockwise direction below the web within the application chamber when the backing roll is rotating in a counter-clockwise direction.

As the coating speed is increased, particularly above 4,500 feet per minute, there exists a tendency for such entrained air to intermittently escape from the application chamber past the metering blade, thereby producing a streaky appearance on the resultant coated web.

The present invention overcomes the aforementioned problem by the provision of means disposed within the application chamber for removing the aforementioned entrained air from the application chamber.

Generally, the present invention includes a perforate conduit extending through the application chamber in a cross-machine direction. The conduit is connected to ambient atmosphere or to a source of partial vacuum. The arrangement is such that the entrained air flows from the air vortex through the perforate conduit away from the application chamber, thereby inhibiting streaking on the resultant coated web.

Therefore, it is a primary objective of the present invention to provide a coater apparatus that overcomes the aforementioned problems associated with the prior art coaters and which makes a considerable contribution to the web coating art.

Another object of the present invention is the provision of a short dwell coater apparatus having a perforate conduit disposed within an application chamber and extending in a cross-machine direction. The conduit permits the flow therethrough of a vortex of entrained air generated within the chamber such that in use of the apparatus, when the vortex of entrained air is generated within the chamber, the air flows through the perforate conduit away from the chamber so that streaking of the coating material due to the intermittent escape of the entrained air past the metering blade is inhibited.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a short dwell coater apparatus and method for applying coating material onto a web guided by a backing roll. The apparatus includes a coater housing which is disposed in close proximity to the backing roll such that the web guided by the backing roll moves between the backing roll and the housing. The housing defines an application chamber which is open towards the web and which extends along the web in a cross-machine direction. The application chamber is connected to a source of the coating material such that the coating material is applied to the web during movement of the web past the chamber.

The coater housing has an upstream lip which is disposed upstream relative to the chamber and adjacent to the web. The lip defines an upstream coating overflow for permitting excess coating material to flow therethrough.

A flexible coater metering blade is disposed downstream relative to the chamber. The blade extends from the housing towards the web for metering the coating material applied to the web.

A perforate conduit is disposed within the chamber and extends in a cross-machine direction. The conduit permits the flow therethrough of a vortex of entrained air generated within the chamber. The arrangement is such that in use of the apparatus, when the vortex of entrained air is generated within the chamber, the air flows through the perforate conduit away from the chamber so that streaking of the coating material due to the intermittent escape of the entrained air past the metering blade is inhibited.

In a more specific embodiment of the present invention, the coater housing also includes a frame and pivot means disposed between the chamber and the frame for permitting pivotal movement of the chamber relative to the backing roll.

The source of the coating material is pressurized such that the pressurized coating material is applied to the web.

The arrangement is such that excess coating material within the chamber flows through the overflow in a direction opposite to the direction of movement of the web.

The flexible metering blade also includes control means disposed on the opposite side of the blade relative to the chamber for controlling the pressure exerted by the metering blade on the coating material.

The perforate conduit includes a tube which extends through the chamber in a cross-machine direction. The tube defines a plurality of holes for permitting the flow therethrough of the entrained air.

More particularly, each hole of the plurality of holes are aligned such that each of the holes is disposed on a line extending in a cross-machine direction.

The perforate conduit also includes a plurality of branch channels with each branch channel being connected to the tube diametrically opposite to a corresponding hole of the plurality of holes. The arrangement is such that the entrained air flows through the holes, through the tube and then through the channels away from the chamber.

The perforate conduit may be connected to either the ambient atmosphere or to a source of partial vacuum.

The perforate conduit also includes adjusting means which extend between the housing and the conduit for permitting adjustment of the location of the conduit such that the entrained air is permitted to escape through the conduit rather than past the metering blade so that streaking of the coating of the resultant web is inhibited.

The present invention also includes a method for applying coating material onto a web guided by a backing roll. The method includes the steps of guiding the web by the backing roll such that the web is guided between a coater housing and the backing roll, the coater housing being disposed in close proximity to the backing roll. The housing defines an application chamber which is open towards the web and which extends along the web in a cross-machine direction.

The application chamber is connected to a source of the coating material such that the coating material is applied to the web during movement of the web past the chamber.

Excess coating material is permitted to flow through an upstream coating overflow defined between an upstream lip of the coater housing and the web.

The coating material is applied to the web by means of a flexible coater metering blade disposed downstream relative to the chamber, the blade extending from the housing towards the web.

The flow of a vortex of entrained air generated within the chamber is permitted to flow through a perforate conduit disposed within the chamber and extending in a cross-machine direction such that when the vortex of entrained air is generated within the chamber, the air flows through the perforate conduit away from the chamber. The arrangement is such that streaking of the coating material due to the intermittent escape of the entrained air past the metering blade is inhibited.

Many modifications and variations of the present invention will be readily apparent to those skilled in the art by a careful consideration of the detailed description contained hereinafter, taken in conjunction with the annexed drawings. However, such modifications and variations fall within the spirit and scope of the present invention as defined by the appended claims.

DETAILED DESCRIPTION OF THE DRAWINGS

Figure 1:
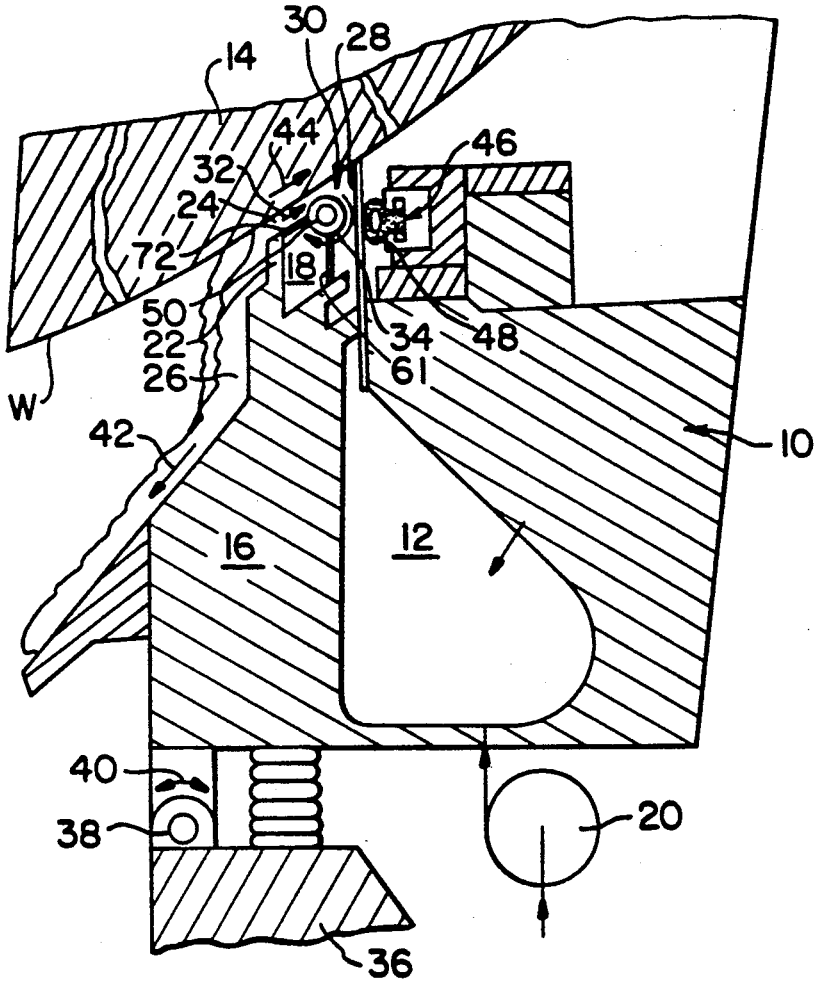
FIG. 1 is a side-elevational view of a short dwell coater apparatus according to the present invention.

FIG. 1 is a side-elevational view of a short dwell coater apparatus, generally designated 10 according to the present invention, for applying coating material 12 onto a web W guided by a backing roll 14.

The apparatus 10 includes a coater housing 16 which is disposed in close proximity to the backing roll 14 such that the web W guided by the backing roll 14 moves between the backing roll 14 and the housing 16.

The housing 16 defines an application chamber 18 which is open towards the web W and which extends along the web W in a cross-machine direction. The application chamber 18 is connected to a source 20 of the coating material 12 such that the coating material 12 is applied to the web W during movement of the web W past the chamber 18.

The coater housing 16 has an upstream lip 22 disposed upstream relative to the chamber 18 and adjacent to the web W. The lip 22 defines an upstream coating overflow 24 for permitting excess coating material 26 to flow therethrough.

A flexible coater metering blade 28 is disposed downstream relative to the chamber 18. The blade 28 extend from the housing 16 towards the web W for metering the coating material 12 applied to the web W.

A perforate conduit, generally designated 30, is disposed within the chamber 18 and extends in a cross-machine direction. The conduit 30 permits the flow therethrough, as indicated by the arrow 32, of a vortex 34 of entrained air generated within the chamber 18 such that in use of the apparatus, when the vortex 34 of entrained air is generated within the chamber 18, the air 34 flows through the perforate conduit 30 away from the chamber 18 so that streaking of the coating material 12 due to the intermittent escape of the entrained air 34 past the metering blade 28 is inhibited.

More particularly, as shown in FIG. 1, the coater housing 16 also includes a frame 36 and pivot means 38 disposed between the chamber 18 and the frame 36 for permitting pivotal movement, as indicated by the arrow 40, of the chamber 18 relative to the backing roll 14.

The source 20 of the coating material 12 is a pressurized source such that the pressurized coating material 12 is applied to the web W.

The source 20 of the coating material 12 is a pressurized source such that excess coating material 26 within the chamber 18 flows through the overflow 24 in a direction, as indicated by the arrow 42, opposite to the direction of movement of the web, as indicated by the arrow 44.

The flexible blade 28 further includes control means, generally designated 46 , disposed on the opposite side of the blade 28 relative to the chamber 18 for controlling the pressure exerted by the blade 28 on the coating material 12.

More specifically, the control means 46 includes a pneumatic tube 48 extending in a cross-machine direction along the metering blade 28 so that the pressure exerted by the blade 28 on the coating material 12 may be controlled.

The perforate conduit 30 also includes a tube 50 which extends through the chamber 18 in a cross-machine direction.

Figure 2:
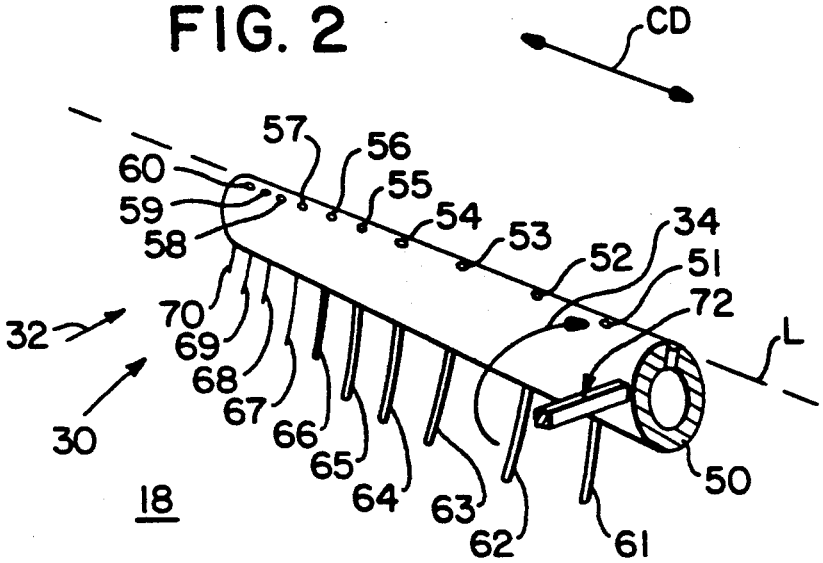
FIG. 2 is an enlarged perspective view of the perforate conduit shown in FIG. 1.

FIG. 2 is an enlarged perspective view of the perforate conduit 30 shown in FIG. 1. The perforate conduit 30 includes the tube 50 which defines a plurality of holes 51,52,53,54,55,56,57,58,59 and 60 for permitting the flow 32 therethrough of the entrained air 34. Each hole of the plurality of holes 51 to 60 are aligned such that each of the holes 51 to 60 is disposed on a line L which extends in a cross-machine direction CD.

The perforate conduit 30 also includes a plurality of branch channels 61,62,63,64,65,66,67,68,69 and 70. Each branch channel of the plurality of branch channels 61 to 70 is connected to the tube 50 diametrically opposite to a corresponding hole of the plurality of holes 51 to 60 such that the entrained air 34 flows through the holes 51 to 60, through the tube 50 and then through the channels 61 to 70 away from the chamber 18.

The perforate conduit 30, or more particularly, the channels 61 to 70, may be connected to either the ambient atmosphere or to a source of partial vacuum.

The perforate conduit 30 also includes adjusting means, generally designated 72, which extend between the housing 16 and the conduit 30 for permitting adjustment of the location of the conduit 30 such that the entrained air 34 is permitted to escape through the conduit 30 rather than past the metering blade 28 so that streaking of the resultant web is inhibited.

In operation of the coater apparatus according to the present invention, coating material is supplied from the source 20 to the application chamber 18 where the coating material 12 is applied to one side of the web W as the web W supported by the backing roll 14 moves past the open end of the application chamber 18.

The metering blade 28 meters excess coating from the web, thereby causing a backflow of coating material through the overflow 24, which may be filtered and recycled.

When the coater is operated at speeds in excess of 4,500 feet per minute, an air vortex is generated within the application chamber 18, such vortex generally rotating in a clockwise direction as indicated by the arrow 34, which is opposite to the direction of rotation of the backing roll 14 as indicated by arrow 44.

Such entrained air 34 flows, as indicated by the arrow 32, through holes 51 to 60 and through the tube 50 and branch channels 61 to 70 to ambient atmosphere or to a slight vacuum source.

The removal of such entrained vortex of air from within the application chamber 18 inhibits streaking of the resultant coated web because such entrained air no longer intermittently escapes past the metering blade 28 to cause such streaking.

The present invention provides a relatively low cost means for overcoming the problem of coater streaking caused by air entrainment within a short dwell coater.

The present invention enables the successful application of coating material to a web without streaking at speeds far in excess of 4,500 feet per minute.

What is claimed is:

1. A short dwell coater apparatus for applying coating material onto a web guided by a backing roll, said apparatus comprising:

a coater housing disposed in close proximity to the backing roll such that the web guided by the backing roll moves between the backing roll and said housing, said housing defining an application chamber which is open towards the web and which extends along the web in a cross-machine direction, said application chamber being connected to a pressurized source of the coating material such that the coating material is applied to the web during movement of the web past said chamber;

said coater housing having an upstream lip disposed upstream relative to said chamber and adjacent to the web, said lip defining an upstream coating overflow for permitting excess coating material to flow therethrough;

a flexible coater metering blade disposed downstream relative to said chamber, said blade extending from said housing towards the web for metering the coating material applied to the web;

a perforate conduit disposed within said chamber and extending in a cross-machine direction, said conduit permitting the flow therethrough of a vortex of entrained air generated within said chamber such that in use of the apparatus, when said vortex of entrained air is generated within said chamber, said air flows through said perforate conduit away from said chamber so that streaking of the coating material due to the intermittent escape of said entrained air past said metering blade is inhibited;

said perforate conduit including:

a tube extending through said chamber in a cross-machine direction, said tube defining a plurality of holes for permitting the flow therethrough of said entrained air;

each hole of said plurality of holes being aligned such that each of said holes is disposed on a line extending in a cross-machine direction; and a plurality of branch channels, each branch channel being connected to said tube diametrically opposite to a corresponding hole of said plurality of holes such that said entrained air flows through said holes, through said tube and then through said channels away from said chamber.

2. A coater apparatus as set forth in claim 1 wherein said coater housing further includes:

a frame;

pivot means disposed between said chamber and said frame for permitting pivotal movement of the said chamber relative to the backing roll.

3. A coater apparatus as set forth in claim 1 wherein said flexible blade further includes:

control means disposed on the opposite side of said blade relative to said chamber for controlling the pressure exerted by said blade on the coating material.

4. A coater apparatus as set forth in claim 1 wherein said perforate conduit is connected to the ambient atmosphere.

5. A coater apparatus as set forth in claim 1 wherein said perforate conduit is connected to a source of partial vacuum.

6. A coater apparatus as set forth in claim 1 wherein said perforate conduit further includes:

adjusting means extending between said housing and said conduit for permitting adjustment of the location of said conduit such that said entrained air is permitted to escape through said conduit rather than past said metering blade so that streaking of the coating of the resultant web is inhibited.

7. A short dwell coater apparatus for applying coating material onto a web guided by a backing roll, said apparatus comprising:

a coater housing disposed in close proximity to the backing roll such that the web guided by the backing roll moves between the backing roll and said housing, said housing defining an application chamber which is open towards the web and which extends along the web in a cross-machine direction, said application chamber being connected to a source of the coating material such that the coating material is applied to the web during movement of the web past said chamber;

said coater housing having an upstream lip disposed upstream relative to said chamber and adjacent to the web, said lip defining an upstream coating overflow for permitting excess coating material to flow therethrough;

a flexible coater metering blade disposed downstream relative to said chamber, said blade extending from said housing towards the web for metering the coating material applied to the web;

a perforate conduit disposed within said chamber and extending in a cross-machine direction, said conduit permitting the flow therethrough of a vortex of entrained air generated within said chamber such that in use of the apparatus, when said vortex of entrained air is generated within said chamber, said air flows through said perforate conduit away from said chamber so that streaking of the coating material due to the intermittent escape of said entrained air past said metering blade is inhibited;

said perforate conduit including:

a tube extending through said chamber in a cross-machine direction, said tube defining a plurality of holes for permitting the flow therethrough of said entrained air;

each hole of said plurality of holes being aligned such that each of said holes is disposed on a line extending in a cross-machine direction; and said perforate conduit further including:

a plurality of branch channels, each branch channel being connected to said tube diametrically opposite to a corresponding hole of said plurality of holes such that said entrained air flows through said holes, through said tube and then through said channels away from said chamber.

* * * * *